US011220650B2

(12) United States Patent
Watanabe et al.

(10) Patent No.: US 11,220,650 B2
(45) Date of Patent: Jan. 11, 2022

(54) GREASE COMPOSITION

(71) Applicant: SHELL OIL COMPANY, Houston, TX (US)

(72) Inventors: Kazuya Watanabe, Tokyo (JP); Keiji Tanaka, Tokyo (JP); Hiroki Yano, Tokyo (JP)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 16/652,599

(22) PCT Filed: Sep. 28, 2018

(86) PCT No.: PCT/EP2018/076517

§ 371 (c)(1),
(2) Date: Mar. 31, 2020

(87) PCT Pub. No.: WO2019/068589

PCT Pub. Date: Apr. 11, 2019

(65) Prior Publication Data

US 2020/0231895 A1 Jul. 23, 2020

(51) Int. Cl.

| | |
|---|---|
| ***C10M 169/02*** | (2006.01) |
| ***C10M 117/00*** | (2006.01) |
| ***C10N 30/00*** | (2006.01) |
| ***C10N 10/04*** | (2006.01) |
| ***C10N 30/08*** | (2006.01) |
| ***C10N 40/02*** | (2006.01) |
| ***C10N 50/10*** | (2006.01) |

(52) U.S. Cl.

CPC ..... *C10M 169/02* (2013.01); *C10M 117/00* (2013.01); *C10M 2207/1216* (2013.01); *C10M 2207/1236* (2013.01); *C10M 2207/1256* (2013.01); *C10M 2207/1276* (2013.01); *C10M 2207/1406* (2013.01); *C10N 2010/04* (2013.01); *C10N 2030/08* (2013.01); *C10N 2030/68* (2020.05); *C10N 2040/02* (2013.01); *C10N 2050/10* (2013.01)

(58) Field of Classification Search

CPC ..... C10M 117/00; C10M 169/02; C10M 2203/1006; C10M 2203/1065; C10M 2205/0206; C10M 2207/1216; C10M 2207/1236; C10M 2207/1256; C10M 2207/1276; C10M 2207/1406; C10N 2010/04; C10N 2030/08; C10N 2030/68; C10N 2040/02; C10N 2040/04; C10N 2050/10

See application file for complete search history.

(56) References Cited

U.S. PATENT DOCUMENTS

| | | | | |
|---|---|---|---|---|
| 3,223,633 | A * | 12/1965 | Morway | C10M 5/00 508/512 |
| 5,385,682 | A * | 1/1995 | Hutchings | C10M 169/06 508/178 |
| 9,290,715 | B2 | 3/2016 | Watanabe et al. | |
| 2011/0251113 | A1* | 10/2011 | Daegling | C10M 169/02 508/506 |
| 2014/0329730 | A1* | 11/2014 | Watanabe | C10M 169/02 508/178 |

FOREIGN PATENT DOCUMENTS

| | | | | |
|---|---|---|---|---|
| CA | 3028939 | A1 * | 1/2018 | C10M 141/12 |
| CN | 85108442 | A | 6/1987 | |
| CN | 101935573 | A | 1/2011 | |
| EP | 2935539 | A1 | 10/2015 | |
| JP | 2009249419 | A | 10/2009 | |
| JP | 5943479 | B2 | 7/2016 | |
| WO | 2010058021 | A1 | 5/2010 | |

OTHER PUBLICATIONS

International Search Report and Written Opinion received for PCT Patent Application No. PCT/EP2018/076517, dated Dec. 11, 2018, 10 pages.

Office Action Received for CN Application No. 201880061911.1, dated Aug. 31, 2021, 15 Pages(08 Pages of English Translation and 07 Pages of Official Copy).

* cited by examiner

*Primary Examiner* — James C Goloboy
(74) *Attorney, Agent, or Firm* — Shell Oil Company

(57) ABSTRACT

A grease composition containing a base oil and a calcium complex soap as a thickening agent, wherein a C18-22 straight chain, substituted or unsubstituted higher fatty acid; a substituted or unsubstituted aromatic monocarboxylic acid having a benzene ring; a C2-4 straight-chain saturated lower fatty acid; and a substituted or unsubstituted saturated dicarboxylic acid are used as carboxylic acids constituting the calcium complex soap.

9 Claims, No Drawings

GREASE COMPOSITION

The present application is the National Stage (§ 371) of International Application No. PCT/EP2018/076517, filed Sep. 28, 2018, which claims priority from Japanese Application 2017-193046, filed Oct. 2, 2017 incorporated herein by reference.

FIELD OF THE INVENTION

The present invention relates to a grease composition. More particularly, the present invention relates to a calcium complex grease composition.

BACKGROUND OF THE INVENTION

Recently, with the advancement of mechanical technology, the lubrication environment is becoming harsher and consequently, there is an increased demand for improved performance at high temperatures, and the grease satisfying this demand is required.

Of these, for example, the lithium complex grease having a wider operating temperature range than the lithium grease has been proposed for the lithium soap-based grease. However, since the lithium is a raw material of lithium grease, there is a concern about instability of supply or steep rise in cost in the future due to a recent increase in demand.

On the other hand, the urea grease is widely used as high temperature grease, but some substances used as raw materials are highly toxic, and it is necessary to pay sufficient attention to handling of these substances in preparing grease. Therefore, there is a demand for materials that constitutes a grease composition having high supply stability, high environmental compatibility, and heat resistance.

From among the above backgrounds, the present applicant invented a calcium complex grease according to JP5943479 as a grease capable of maintaining a suitable consistency even with a small amount of thickening agent.

However, due to further advancement of market needs, improvement of shear stability of grease is strongly demanded.

The present inventors found that above-mentioned problems of shear stability (softening) can be solved by further introducing a specific carboxylic acid into a component of a calcium complex thickening agent composed of a higher fatty acid, a lower fatty acid, and an aromatic carboxylic acid.

SUMMARY OF THE INVENTION

The present invention is directed to a grease composition containing a base oil and a calcium complex soap as a thickening agent, wherein a C18-22 straight chain, substituted or unsubstituted higher mono fatty acid; a substituted or unsubstituted aromatic monocarboxylic acid having a benzene ring; a C2-4 straight-chain saturated lower mono fatty acid; and a substituted or unsubstituted saturated dicarboxylic acid are used as carboxylic acids constituting the calcium complex soap.

The present invention is also directed to said grease composition, wherein a weight ratio of the calcium dicarboxylate compound to the total thickening agent of the grease composition is 5 to 70%.

The present invention is also directed to said grease composition wherein the substituted or unsubstituted saturated dicarboxylic acid has 4 to 20 carbon atoms.

DETAILED DESCRIPTION OF THE INVENTION

According to the calcium complex grease composition of the present invention, it is possible to provide a grease composition having excellent shear stability as compared with the conventional calcium complex grease.

Hereinafter, an embodiment of the present invention will be described, but the technical scope of the present invention is not limited by the embodiment in any way.

The grease composition of the present embodiment includes "base oil" and "thickening agent" as essential structural components. Hereinafter, components included in the grease composition, the amount (blended amount) of each component in the grease composition, the method for producing the grease composition, the properties of the grease composition and the use of the grease composition will be described in said order.

The base oil used in the grease composition of the present embodiment is not particularly limited. For example, oil used in general grease compositions such as mineral oil, synthetic oil, animal and vegetable oils or mixed oil thereof may be appropriately used. As specific examples, base oils belonging to Group 1, Group 2, Group 3, Group 4 and the like in the API (American Petroleum Institute) base oil category may be used singly or as a mixture.

Examples of the Group 1 base oil include paraffin-based mineral oils which can be obtained by refining a lubricating oil distillate obtained from an atmospheric distillation of crude oil, by appropriately combining means of solvent refining, hydrorefining, dewaxing or the like. Examples of the Group 2 base oil include paraffin-based mineral oils which can be obtained by refining a lubricating oil distillate obtained from an atmospheric distillation of crude oil, by appropriately combining means of hydrogenolysis, dewaxing or the like. The Group 2 base oil refined by Gulf's hydrorefining or the like has less than 10 ppm sulphur content and 5% or less aroma content, and may be preferably used in the present invention.

Examples of the Group 3 base oil and Group 2 plus base oil include paraffin-based mineral oils which can be manufactured by subjecting a lubricating oil distillate obtained from an atmospheric distillation of crude oil to high hydrorefining, base oils refined by the ISODEWAX process according to which a wax produced by a dewaxing process is converted/dewaxed to isoparaffin, and base oils refined by the Mobil wax isomerisation process, and these oils may also be preferably used in the present embodiment.

Examples of synthetic oil include polyolefins, diesters of dibasic acid, triesters of trimellitic acid, polyol esters, alkyl benzenes, alkyl naphthalenes, esters, polyoxyalkylene glycols, polyoxyalkylene glycol esters, polyoxyalkylene glycol ethers, polyphenyl ethers, dialkyl diphenyl ethers, fluorine-containing compounds (perfluoropolyether, fluorinated polyolefin and the like), silicones and the like. The above-mentioned polyolefins include various olefin polymers and hydrides thereof. Any olefins may be used, and examples include ethylene, propylene, butene, α-olefins having 5 or more carbon atoms and the like. Polyolefins may be produced by using one of the above-mentioned olefins or two or more of them in combination. In particular, so-called poly-α-olefin (PAO) is preferably used as a polyolefin, which is a Group 4 base oil.

Oils synthesized by means of GTL (gas to liquid) by the Fischer-Tropsch process, which is the technology of obtaining liquid fuel from natural gas, have significantly lower sulphur and aroma contents and a significantly higher paraffin component ratio than mineral base oils obtained by refining crude oils, and therefore exhibit excellent oxidation stability and extremely small evaporation loss. Thus, the oils can be preferably used as the base oil of the present embodiment.

The thickening agent used in the present embodiment is a calcium complex soap obtained by a plurality of carboxylic acids being reacted with a specific base (typical examples include calcium hydroxide). Herein, the term "complex" in the calcium complex soap according to the present embodiment means that a plurality of carboxylic acids is employed. There are four source carboxylic acids for the calcium complex soap according to the present embodiment, which are (1) higher fatty acid, (2) aromatic monocarboxylic acid, (3) lower fatty acid and (4) dicarboxylic acid. Note that the carboxylic acids other than these may be used within the scope, not impairing the effect of the present invention. Hereinafter, the carboxylic acid moieties (anion moieties) in the calcium complex soap will be described in detail.

The higher fatty acid used in the present embodiment is a C18-22 straight-chain higher fatty acid. Herein, the straight-chain higher fatty acid may be unsubstituted or substituted with one or more substituents (for example, a hydroxyl group or the like). The straight-chain higher fatty acid may be a saturated or unsaturated fatty acid, but is preferably a saturated fatty acid. Specific examples of a saturated fatty acid include stearic acid (octadecanoic acid, C18), tuberculostearic acid (nonadecanoic acid, C19), arachidic acid (icosanoic acid, C20), heneicosanoic acid (C21), behenic acid (docosanoic acid, C22) and hydroxystearic acid (C18, hydrogenated castor oil fatty acid), and examples of an unsaturated fatty acid include oleic acid, linoleic acid, linolenic acid (C18), gadoleic acid, eicosadienoic acid, mead acid (C20), erucic acid, docosadienoic acid (C22) and the like. Hydrogenated oil obtained by adding hydrogen to oils and fats rich in unsaturated fatty acids such as castor oil using a catalyst such as nickel may be used instead of higher fatty acids. These acids may be used alone or a plurality of them may be used in combination. For example, in the case of including an unsaturated fatty acid, a saturated fatty acid is preferably used in combination.

The aromatic monocarboxylic acid used in the present embodiment is a substituted or unsubstituted aromatic monocarboxylic acid having a benzene ring. Herein, the aromatic monocarboxylic acid may be unsubstituted or substituted with one or more substituents (for example, an o-, m- or p-alkyl group, a hydroxy group, an alkoxy group or the like). Specific examples include benzoic acid, methyl benzoic acid {toluic acid (p-, m-, o-)}, dimethyl benzoic acid (xylyl acid, hemellitic acid, mesitylenic acid), trimethyl benzoic acid {prehnitylic acid, durylic acid, isodurylic acid (α-, β-, γ-)}, 4-isopropylbenzoic acid (cuminic acid), hydroxybenzoic acid (salicylic acid), dihydroxybenzoic acid {pyrocatechuic acid, resorcylic acid (α-, β-, γ-), gentisic acid, protocatechuic acid}, trihydroxybenzoic acid (gallic acid), hydroxy-methyl benzoic acid {cresotinic acid (p-, m-, o-)}, dihydroxymethyl benzoic acid (orsellinic acid), methoxybenzoic acid {anisic acid (p-, m-, o-)}, dimethoxybenzoic acid (veratric acid), trimethoxybenzoic acid (asaronic acid), hydroxy-methoxy benzoic acid (vanillic acid, isovanillic acid), hydroxy-dimethoxy benzoic acid (syringic acid) and the like. These may be used alone or a plurality of them may be used in combination. In the present specification, alkyl in the "substituent" and alkyl moiety in alkoxy are, for example, 1 to 4 straight chain or branched alkyls.

The lower fatty acid used in the present embodiment is a C2-4 straight-chain saturated lower fatty acid. Specific examples include acetic acid (C2), propionic acid (C3) and butyric acid (C4). Of these, acetic acid (C2) is particularly preferred. These may be used alone or a plurality of them may be used in combination.

The dicarboxylic acid used in the present embodiment is substituted or unsubstituted saturated dicarboxylic acid. Herein, the saturated dicarboxylic may be unsubstituted or substituted with one or more substituents (for example, a hydroxyl group or the like). The saturated dicarboxylic acid may be either straight chain or branched, but is preferably a straight chain. The number of carbon atoms of the saturated dicarboxylic acid (in the case of branched chain, the total number of carbon atoms in the main chain and the side chain) is not particularly limited, but is preferably 4 to 20, more preferably 4 to 16, and particularly preferably 4 to 10. Specific examples include oxalic acid (C2), malonic acid (C3), succinic acid (C4), pentanedioic acid (C5) such as 2-methylsuccinic acid and glutaric acid, hexanedioic acid (C6) such as adipic acid, heptanedioic acid (C7) such as pimelic acid, octanedioic acid (C8) such as suberic acid, nonanedioic acid (C 9) such as azelaic acid, decanedioic acid (C10) such as sebacic acid, undecanedioic acid (C 11), dodecanedioic acid (C 11), tridecanedioic acid (C13) such as brasylic acid, tetradecanedioic acid (C14), pentadecandioic acid (C15), hexadecandioic acid (C16), heptadecandioic acid (C17), octadecanedioic acid (C18), nonadecanedioic acid (C19), icosanedioic acid (C20) and the like. These may be used alone or a plurality of them may be used in combination.

Thus, the grease composition of the present embodiment contains not only the straight-chain higher fatty acid, the aromatic monocarboxylic acid and the lower fatty acid but also contains the dicarboxylic acid. By further prescribing dicarboxylic acid into the structural components, the higher mono fatty acid, the aromatic monocarboxylic acid, and the lower mono fatty acid, the fibers of these plurality of soaps are entangled very complexly and tightly. As a result, it is estimated that the grease composition according to the present embodiment is more excellent in shear stability (moreover, excellent in heat resistance). The reason why fibers are effectively entangled and strengthened by prescribing the dicarboxylic acid is not clear at the present time. However, it is considered that randomly bonding divalent calcium and dicarboxylic acid results in polymers including calcium dicarboxylate, the fibers easily change to long fibers, and easily entangle in a single fiber becoming stronger.

Note that a combination of stearic acid or behenic acid as the straight-chain higher fatty acid, benzoic acid as the aromatic monocarboxylic acid, and acetic acid as the lower fatty acid is the most preferred combination.

For the grease composition of the present embodiment, other thickening agent may also be used in combination with the above calcium complex soap. Examples of thickening agents include tricalcium phosphates, alkali metal soaps, alkali metal complex soaps, alkaline earth metal soaps, alkaline earth metal complex soaps (other than calcium complex soaps), alkali metal sulfonates, alkaline earth metal sulfonates, other metal soaps, terephthalamate metal salts, clay, silica (silicon oxide) such as silica aerogel, fluorine resins such as polytetrafluoroethylene, and the like. These may be used alone or in combination of two or more kinds. Apart from the listed examples, any substances capable of imparting thickening effects to a liquid substance may be used.

The grease composition of the present embodiment may also include optional additives such as an antioxidant, an anti-rust agent, an oiliness improver, an extreme pressure agent, an anti-wear agent, a solid lubricant, a metal deactivator, a polymer, a metallic detergent, a non-metallic detergent, a defoaming agent, a colouring agent and a water repellent agent, where the total amount of optional components is about 0.1 to 20 parts by mass based on 100 parts by mass of the total grease composition. Examples of the antioxidant include 2,6-di-t-butyl-4-methylphenol, 2,6-di-t-butyl-para-cresol, p,p'-dioctyldiphenylamine, N-phenyl-α-naphthylamine, phenothiazine and the like. Examples of the anti-rust agent include paraffin oxide, metal salt of carboxylic acids, metal salt of sulfonic acids, carboxylic acid ester, sulfonic acid ester, salicylic acid ester, succinic acid ester, sorbitan ester and other various amine salts. Examples of the oiliness improver, extreme pressure agent and the anti-wear agent include sulfurized zinc dialkyl dithiophosphate, sulfurized zinc diallyl dithiophosphate, sulfurized zinc dialkyl dithiocarbamate, sulfurized zinc diallyl dithiocarbamate, sulfurized molybdenum dialkyl dithiophosphate, sulfurized molybdenum diallyl dithiophosphate, sulfurized molybdenum dialkyl dithiocarbamate, sulfurized molybdenum diallyl dithiocarbamate, an organic molybdenum complex, a sulfurized olefin, triphenyl phosphate, triphenyl phosphorothionate, tricresine phosphate, other phosphate esters, sulfurized fats and oils and the like. Examples of the solid lubricant include molybdenum disulfide, graphite, boron nitride, melamine cyanurate, PTFE (polytetrafluoroethylene), tungsten disulfide, graphite fluoride and the like. Examples of the metal deactivator include N,N'-disalicylidene-1,2-diaminopropane, benzotriazole, benzimidazole, benzothiazole, thiadiazole and the like. Examples of the polymer include polybutene, polyisobutene, polyisobutylene, polyisoprene, polymethacrylate and the like. Examples of the metal-based detergent include metal sulfonate, metal salicylate, metal phenate and the like. Examples of the non-metallic detergent include succinic acid imide and the like. Examples of the defoaming agent include methyl silicone, dimethyl silicone, fluorosilicone, polyacrylate and the like Next, the blended amount for the grease composition according to the present embodiment will be described.

The blending amount of the base oil is preferably 60 to 99 parts by mass, more preferably 70 to 97 parts by mass, further preferably 80 to 95 parts by mass, with respect to 100 parts by mass of the total amount of the grease composition.

The blending amount of the calcium complex soap is preferably 1 to 40 parts by mass, further preferably 3 to 25 parts by mass, with respect to 100 parts by mass of the total amount of the grease composition.

The blending amount of the higher fatty acid is preferably 20 to 70 parts by mass, further preferably 30 to 65 parts by mass, with respect to 100 parts by mass of the total amount of the carboxylic acid.

The blending amount of the aromatic monocarboxylic acid is preferably 1 to 10 parts by mass, further preferably 3 to 10 parts by mass, with respect to 100 parts by mass of the total amount of the carboxylic acid.

The blending amount of the lower fatty acid is preferably 5 to 30 parts by mass, further preferably 10 to 25 part by mass, with respect to parts by mass of the total amount of the carboxylic acid.

The blending amount of the dicarboxylic acid is preferably 1 to 70 parts by mass, further preferably 5 to 55 parts by mass, with respect to 100 parts by mass of the total amount of the carboxylic acid.

Here, the amount of the calcium dicarboxylate compound (calcium dicarboxylate soap after dehydration) after the saponification of the dicarboxylic acid and the basic calcium (typically, calcium hydroxide) is preferably 5 to 70 parts by weight, more preferably 5 to 60 parts by mass, based on the total amount of the thickening agent (calcium complex soap content after dehydration) in the grease composition. Note that, the calcium dicarboxylate compound shown here may be a reaction product of a dicarboxylic acid and basic calcium, and includes a cyclic compound and a polymeric compound, and also includes a compound whose terminal is calcium monocarboxylate.

The mass ratio of the higher fatty acid to the dicarboxylic acid is preferably 20:80 to 95:5, more preferably 30:70 to 85:15.

The mass ratio of the aromatic monocarboxylic acid to the dicarboxylic acid is preferably 5:95 to 70:30, and more preferably 15:85 to 65:35.

The mass ratio of the lower fatty acid to the dicarboxylic acid is preferably 5:95 to 85:15, more preferably 15:85 to 80:20.

The grease composition of the present embodiment may be produced according to a method generally used for producing grease. The production method is not particularly limited, and an example includes a method as production example 1 which involves mixing a base oil, a higher fatty acid, a lower fatty acid and an aromatic monocarboxylic acid in a grease manufacturing vessel, and dissolving the contents at a temperature between 60 and 90° C. Subsequently, calcium hydroxide which is preliminarily dissolved and dispersed in an appropriate amount of distilled water is charged into the vessel. Various carboxylic acids undergo a saponification reaction with basic calcium (typically, calcium hydroxide), soap is slowly formed in the base oil, and the resulting product is further heated and dehydrated. Subsequently, the dicarboxylic acid is mixed in the vessel, and simultaneously the calcium hydroxide dissolved and dispersed in distilled water is charged into the vessel. The mixture is then saponified and dehydrated to form a grease thickening agent. After the completion of dehydration, the grease is heated to a temperature of 180 to 220° C., thoroughly stirred and mixed, and cooled down to room temperature. Thereafter, a mill (for example, a three-roll mill, and the like.) is used in order to obtain a uniform grease composition. Or, a method as production example 2 which involves mixing a base oil, a higher fatty acid, a lower fatty acid, an aromatic monocarboxylic acid and an organic acid, dicarboxylic acid, in a grease manufacturing vessel, and dissolving the contents at a temperature between 60 and 90° C. Subsequently, the basic calcium (typically, calcium hydroxide) which is preliminary dissolved and dispersed in an appropriate amount of distilled water is charged into the vessel and then subjected to saponification and the soap is slowly formed in the base oil. The resulting product is further heated and dehydrated to form a grease thickening agent. After the completion of dehydration, the grease is heated to a temperature of 180 to 220° C., thoroughly stirred and mixed, and cooled down to room temperature. Thereafter, a mill (for example, a three-roll mill, and the like.) is used in order to obtain a uniform grease composition. Herein, since the amount of calcium dicarboxylate compound in the grease composition depends on the amount of dicarboxylic acid in the thickening agent raw material, it is considered that no significant difference occurs in the amount of calcium dicarboxylate compound produced even if production methods of production example 1 and production example 2 differ. Therefore, the amount of calcium dicarboxylate compound in the grease composition can be controlled by the amount of dicarboxylic acid to be blended.

Note that, the amount of basic calcium (typically, calcium hydroxide) may be appropriately set based on the amount of carboxylic acid to be blended.

For the grease composition of the present embodiment, a composition having a dropping point equal to or higher than 180° C. is preferably used, more preferably equal to or higher than 210° C., further preferably equal to or higher than 250° C. and particularly preferably equal to or higher than 260° C. It is thought that when the dropping point of the grease composition is 180° C. or higher (it is usually a temperature which is at least 50° C. higher than that of calcium grease), the possibility that lubrication problems will be produced, for example, loss of viscosity at high temperature and leakage caused therefrom, burns and the like, can be suppressed. The dropping point herein refers to the temperature at which viscous grease loses the thickener configuration with increase in temperature. Herein, the dropping point is measured according to JIS K 2220 8.

The consistency of the grease of the present embodiment is preferably Nos. 000 to 6 (85 to 475), more preferably Nos. 0 to 4 (175 to 385) and further preferably Nos. 1 to 3 (220 to 340) according to the consistency test. The consistency indicates the apparent grease hardness. The consistency is measured by carrying out worked penetration measurements according to JIS K 2220 7

The difference (absolute value) in worked penetration of the grease of the present embodiment before and after the rolling stability test (at 25° C., 24 h) is preferably 80 or less, more preferably 70 or less, further preferably 60 or less. Also, the difference (absolute value) in worked penetration of the grease before and after the rolling stability test (at 100° C., 24 h) is preferably 100 or less, more preferably 90 or less, further preferably 80 or less. The rolling stability test is used to evaluate the shear stability of the grease by measuring the consistency (hardness) of the grease after kneading 50 g of test grease with the device for a predetermined period of time. The shear stability of the grease composition is an important element for maintaining the lubrication ability and physical behavior of the grease. Poor shear stability causes grease to readily escape from the lubrication part of machine, and the required lubrication cannot be provided, which results in shortening of life, and also scattering of grease may occur which pollutes the surrounding area of the machine and impairs the working environment. Herein, the rolling stability test which is used to evaluate the shear stability is carried out according to ASTMD 1831.

The grease composition of the present embodiment is excellent in shear stability; hence, it can, of course, be used for generally used machines, bearings, gears and the like, and exhibits excellent performance under severe conditions, for example, under high temperature conditions. For example, the grease composition may be preferably used for lubrication of various components in automobiles such as engine peripherals including the starter, alternator and various actuators, the powertrain including the propeller shaft, constant velocity joint (CVJ), wheel bearing and clutch, the electric power steering (EPS), brake unit, ball joint, door hinge, steering wheel, cooling fan motor, brake expander and the like. In addition, the grease composition may also be preferably used in various high temperature/heavy duty parts in construction machinery such as a power shovel, bulldozer and crane truck, the steel industry, the papermaking industry, forestry machines, agricultural machines, chemical plants, power-generating facilities, drying furnaces, copying machines, railway vehicles, screw joints of seamless pipes and the like. For other purposes, the composition may also be preferably used for hard disk bearings, plastic lubrication, cartridge grease and the like.

EXAMPLES

Next, the present invention will be described in more detail with reference to Examples and Comparative Examples, but the present invention is not limited by these examples in any way.

The raw materials used in the present Examples and Comparative Examples are as follows. Unless otherwise particularly mentioned, the quantities shown in Table 1 were used for Examples 1 to 8 and Comparative Examples 1 to 3. The amount of raw materials shown in Table 1 {in particular, calcium hydroxide and various carboxylic acids (higher fatty acid, aromatic monocarboxylic acid, lower fatty acid and dicarboxylic acid)} is the amount of reagent. Therefore, the actual component amount in the composition can be calculated on the basis of the numerical values in Table 1 and the purity described below.

Calcium hydroxide: special grade reagent having a purity of 96.0%

Stearic acid: C18 straight chain alkyl saturated fatty acid, which was provided as a special grade reagent having a purity of 95.0%

Acetic acid: Alkyl fatty acid having 2 carbon atoms, which was provided as a special grade reagent having a purity of 99.7%.

Tartaric acid: Straight chain dicarboxylic acid having 4 carbon atoms, which was provided as a special grade reagent having a purity of 99.0% or more.

Adipic acid: Straight chain dicarboxylic acid having 6 carbon atoms, which was provided as a special grade reagent having a purity of 99.5% or more.

Azelaic acid: Straight chain dicarboxylic acid having 9 carbon atoms, which was provided as a special grade reagent having a purity of 80.0% or more.

Sebacic acid: Straight chain dicarboxylic acid having 10 carbon atoms, which was provided as a special grade reagent having a purity of 98.0% or more.

Eicosadioic acid: Straight chain dicarboxylic acid having 20 carbon atoms, which was provided as a SL-20 manufactured by Okamura Seiyu Co., Ltd. and having a purity of 75.0% or more.

Base oil A: Paraffin-based mineral oil obtained by dewaxing solvent refinement, belongs to Group 1, the kinetic viscosity at 100° C. was 11.25 $mm^2/s$, and the viscosity index was 97.

Base oil B: Naphthenic mineral oil obtained by dewaxing solvent refinement, belongs to Group 1, the kinetic viscosity at 100° C. was 10.71 $mm^2/s$, and the viscosity index was 30.34.

Base oil C: GTL (gas to liquid) oil synthesized by the Fischer-Tropsch process, belongs to Group 3, the kinetic viscosity at 100° C. was 7.77 $mm^2/s$, and the viscosity index was 148.

Example 1

The base oil and the carboxylic acid other than the dicarboxylic acid were heated in a vessel and the contents were dissolved. Next, the calcium hydroxide which was preliminarily dissolved and dispersed in an appropriate amount of distilled water was charged into the vessel. At this time, various carboxylic acids underwent a saponification reaction with the calcium hydroxide and lithium hydroxide, the soap was slowly formed in the base oil, and the resulting product was further heated and dehydrated. Subsequently, the tartaric acid as the dicarboxylic acid was mixed in the vessel, and simultaneously the calcium hydroxide dissolved and dispersed in distilled water was charged in the vessel. The mixture was then saponified and dehydrated to form a grease thickening agent. After the completion of dehydration, the grease was heated to a temperature of 200° C., thoroughly stirred and mixed, and cooled down to room temperature. Thereafter, a three-roll mill was used in order to obtain uniform grease having No. 2.5 consistency.

Examples 2 to 8, Comparative Examples 1 to 3

The grease composition was prepared in the same manner as in Example 1 except that the raw materials to be blended were as shown in Table 1.

For the grease compositions prepared using the above-mentioned raw material composition and production method, the consistency, dropping point, and roll stability (24 h) were measured according to the methods described above. The results thereof are shown in Table 1. The roll stability indicates the difference (absolute value) in the worked penetration of the grease before and after the test.

TABLE 1

| | | Example 1 Weight ratio % mass | Example 2 Weight ratio % mass | Example 3 Weight ratio % mass | Example 4 Weight ratio % mass | Example 5 Weight ratio % mass | Example 6 Weight ratio % mass |
|---|---|---|---|---|---|---|---|
| Alkali | Calcium hydroxide | 3.52 | 3.87 | 3.52 | 1.86 | 1.24 | 3.52 |
| Long chain fatty acid | Stearic acid | 9.29 | 10.22 | 9.29 | 4.93 | 3.29 | 9.29 |
| Short chain fatty acid | Acetic acid | 2.88 | 3.17 | 2.88 | 1.52 | 1.01 | 2.88 |
| Aromatic carboxylic acid | Benzoic acid | 1.31 | 1.44 | 1.31 | 0.69 | 0.46 | 1.31 |
| Alkali | Calcium hydroxide | 0.99 | 0.43 | 1.01 | 3.70 | 4.71 | 0.85 |
| Dicarboxylic acid | Tartaric acid (C4) | 2.01 | | | | | |
| | Adipic acid (C6) | | 0.87 | 1.99 | 7.30 | 9.29 | |
| | Azelaic acid (C9) | | | | | | 2.15 |
| | Sebacic acid (C10) | | | | | | |
| | Eicosadioic acid (C20) | | | | | | |
| Total of dicarboxylic acid and calcium hydroxide | | 3.00 | 1.30 | 3.00 | 11.00 | 14.00 | 3.00 |
| Calcium dicarboxylate compound (calcium dicarboxylate soap after dehydration) | | 2.52 | 1.09 | 2.51 | 9.20 | 11.71 | 2.59 |
| Total of thickening agent to be blended | | 20.00 | 20.00 | 20.00 | 20.00 | 20.00 | 20.00 |
| Total thickening agent (calcium complex soap content after dehydration) | | 17.71 | 17.80 | 17.70 | 17.24 | 17.07 | 17.78 |
| Base oil A | | 80.00 | 80.00 | 80.00 | 80.00 | 80.00 | 80.00 |
| Base oil B | | | | | | | |
| Base oil C | | | | | | | |
| Total | | 100.00 | 100.00 | 100.00 | 100.00 | 100.00 | 100.00 |
| Calcium dicarboxylate compound/Total thickening agent Weight ratio % | | 14.23 | 6.12 | 14.18 | 53.36 | 68.60 | 14.57 |
| Consistency | Mixed | 248 | 267 | 281 | 305 | 341 | 265 |
| 25° C. | Immiscible | 258 | 272 | 290 | 315 | 356 | 270 |
| | NLGI grade | No. 2.5 | No. 2 | No. 2 | No. 1 | No. 0.5 | No. 2 |
| Dropping point | ° C. | >260 | >260 | >260 | >260 | >260 | >260 |
| Roll stability | | 34 | 11 | 26 | 28 | 13 | 2 |
| 24 h | | 93 | 74 | 65 | 48 | 24 | 76 |

| | | Example 7 Weight ratio % mass | Example 8 Weight ratio % mass | Example 9 Weight ratio % mass | Example 10 Weight ratio % mass | Comparative Example 1 Weight ratio % mass | Comparative Example 2 Weight ratio % mass |
|---|---|---|---|---|---|---|---|
| Alkali | Calcium hydroxide | 3.52 | 2.90 | 3.52 | 2.64 | 4.30 | 4.35 |
| Long chain fatty acid | Stearic acid | 9.29 | 1.65 | 9.29 | 6.97 | 10.80 | 11.86 |
| Short chain fatty acid | Acetic acid | 2.88 | 2.37 | 2.88 | 2.16 | 3.37 | 3.79 |
| Aromatic carboxylic acid | Benzoic acid | 1.31 | 1.08 | 1.31 | 0.98 | 1.53 | |
| Alkali | Calcium hydroxide | 0.80 | 1.60 | 0.53 | 0.76 | | |
| Dicarboxylic acid | Tartaric acid (C4) | | | | | | |
| | Adipic acid (C6) | | | | 1.49 | | |
| | Azelaic acid (C9) | | | | | | |
| | Sebacic acid (C10) | 2.20 | 4.40 | | | | |
| | Eicosadioic acid (C20) | | | 2.47 | | | |
| Total of dicarboxylic acid and calcium hydroxide | | 3.00 | 6.00 | 3.00 | 2.25 | 0.00 | 0.00 |
| Calcium dicarboxylate compound (calcium dicarboxylate soap after dehydration) | | 2.61 | 5.22 | 2.74 | 1.88 | 0.00 | 0.00 |
| Total of thickening agent to be blended | | 20.00 | 20.00 | 20.00 | 15.00 | 20.00 | 20.00 |
| Total thickening agent (calcium complex soap content after dehydration) | | 17.80 | 17.73 | 17.93 | 13.27 | 17.88 | 17.90 |

TABLE 1-continued

| | | | | | | | |
|---|---|---|---|---|---|---|---|
| Base oil A | | 80.00 | 40.00 | 80.00 | 85.00 | 80.00 | 80.00 |
| Base oil B | | | 20.00 | | | | |
| Base oil C | | | 20.00 | | | | |
| Total | | 100.00 | 100.00 | 100.00 | 100.00 | 100.00 | 100.00 |
| Calcium dicarboxylate compound/Total thickening agent Weight ratio % | | 14.66 | 29.44 | 15.28 | 14.17 | 0.00 | 0.00 |
| Consistency | Mixed | 254 | 305 | 315 | 342 | 260 | 290 |
| 25° C. | Immiscible | 266 | 310 | 325 | 350 | 265 | 292 |
| | NLGI grade | No. 2 | No. 1 | No. 1 | No. 0.5 | No. 2 | No. 2 |
| Dropping point | ° C. | >260 | >260 | >260 | >260 | >260 | 190 |
| Roll stability | | 8 | 29 | 68 | 5 | 13 | 23 |
| 24 h | | 82 | 13 | 70 | 80 | >175 | >148 |

That which is claimed is:

1. A grease composition comprising:

(a) a base oil; and (b) a calcium complex soap as a thickening agent, wherein the calcium complex soap comprises a carboxylic acid mixture comprising:

(i) a higher mono fatty acid comprising a substituted or unsubstituted C18-22 straight hydrocarbon chain;

(ii) an aromatic monocarboxylic acid comprising a substituted or unsubstituted aromatic monocarboxylic acid having a benzene ring;

(iii) a saturated lower mono fatty acid comprising an unsubstituted C2-4 straight hydrocarbon chain; and (iv) a dicarboxylic acid comprising a substituted or unsubstituted saturated dicarboxylic acid, wherein the mass ratio of the aromatic monocarboxylic acid to the dicarboxylic acid ranges from 5:95 to 70:30.

2. The grease composition according to claim 1, wherein a calcium salt of the dicarboxylic acid accounts for 5 to 70% by weight of the calcium complex soap.

3. The grease composition according to claim 1, wherein the substituted or unsubstituted saturated dicarboxylic acid has 4 to 20 carbon atoms.

4. The grease composition according to claim 1, wherein the higher mono fatty acid is selected from the group consisting of stearic acid, tuberculostearic acid, arachidic acid, heneicosanoic acid, behenic acid, hydroxystearic acid, oleic acid, linoleic acid, gadoleic acid, eicosadienoic acid, mead acid, erucic acid, and docosadienoic acid.

5. The grease composition according to claim 1, wherein the aromatic monocarboxylic acid is selected from the group consisting of benzoic acid, methyl benzoic acid, p-toluic acid, m-toluic acid, o-toluic acid, dimethyl benzoic acid, xylyl acid, hemellitic acid, mesitylenic acid, trimethyl benzoic acid, prehnitylic acid, durylic acid, isodurylic acid, 4-isopropylbenzoic acid, hydroxybenzoic acid, dihydroxybenzoic acid, pyrocatechuic acid, resorcylic acid, gentisic acid, protocatechuic acid, trihydroxybenzoic acid, hydroxymethyl benzoic acid, cresotinic acid, dihydroxymethyl benzoic acid, methoxybenzoic acid, anisic acid, dimethoxybenzoic acid, trimethoxybenzoic acid, hydroxy-methoxy benzoic acid, and hydroxy-dimethoxy benzoic acid.

6. The grease composition according to claim 1, wherein the saturated lower mono fatty acid is selected from the group consisting of acetic acid, propionic acid, and butyric acid.

7. The grease composition according to claim 1, wherein the dicarboxylic acid is selected from the group consisting of oxalic acid, malonic acid, succinic acid, pentanedioic acid, 2-methylsuccinic acid, glutaric acid, hexanedioic acid, adipic acid, heptanedioic acid, octanedioic acid, nonanedioic acid, decanedioic acid, undecanedioic acid, dodecanedioic acid, tridecanedioic acid, tetradecanedioic acid, pentadecandioic acid, hexadecandioic acid, heptadecandioic acid, octadecanedioic acid, nonadecanedioic acid, and icosanedioic acid.

8. The grease composition according to claim 1, wherein the mass ratio of the saturated lower mono fatty acid to the dicarboxylic acid ranges from 5:95 to 85:15.

9. The grease composition according to claim 1, wherein the mass ratio of the higher mono fatty acid to the dicarboxylic acid ranges from 20:80 to 95:5.

* * * * *